US006821098B2

(12) United States Patent
Lifson

(10) Patent No.: US 6,821,098 B2
(45) Date of Patent: Nov. 23, 2004

(54) SCREW COMPRESSOR HAVING COMPRESSION POCKETS CLOSED FOR UNEQUAL DURATIONS

(75) Inventor: Alexander Lifson, Manlius, NY (US)

(73) Assignee: Carrier Corporation, Syracuse, NY (US)

( * ) Notice: Subject to any disclaimer, the term of this patent is extended or adjusted under 35 U.S.C. 154(b) by 0 days.

(21) Appl. No.: 10/364,119

(22) Filed: Feb. 11, 2003

(65) Prior Publication Data

US 2004/0156735 A1 Aug. 12, 2004

(51) Int. Cl.[7] ..... F04C 18/16
(52) U.S. Cl. ..... 418/201.1; 418/1; 418/197
(58) Field of Search ..... 418/1, 197, 201.1, 418/201.2

(56) References Cited

U.S. PATENT DOCUMENTS 3,108,740 A * 10/1963 Schibbye ..... 418/201.2
5,051,077 A * 9/1991 Yanagisawa et al. .... 418/201.1
6,422,846 B1 * 7/2002 Zhong et al. ..... 418/197
6,585,503 B2 * 7/2003 Okada et al. ..... 418/201.1

FOREIGN PATENT DOCUMENTS

GB 648055 * 12/1950 ..... 418/197
RU 1620681 * 1/1991 ..... 418/201.1
WO WO 88/000294 * 1/1988 ..... 418/201.1

* cited by examiner

*Primary Examiner*—John J. Vrablik
(74) *Attorney, Agent, or Firm*—Bachman & LaPointe, P.C.

(57) ABSTRACT

A compressor has male and female rotors with enmeshed screw-type body portions. A housing cooperates with the rotors to define inlet and outlet chambers for pumping of fluid from/to when the male rotor in a first direction and the female rotor rotates in an opposite direction. The housing cooperates with the rotors to define inlet and outlet ports at the inlet and outlet chambers for each of a male and female compression pocket. The inlet ports and/or outlet ports of the respective male and female compression pockets are positioned to respectively close or open sequentially.

8 Claims, 8 Drawing Sheets

SCREW COMPRESSOR HAVING COMPRESSION POCKETS CLOSED FOR UNEQUAL DURATIONS

BACKGROUND OF THE INVENTION (1) Field of the Invention

This invention relates to compressors, and more particularly to screw-type compressors.

(2) Description of the Related Art

Screw-type compressors are commonly used in air conditioning and refrigeration applications. In such a compressor, intermeshed male and female lobed rotors or screws are rotated about their axes to pump the refrigerant from a low pressure inlet end to a high pressure outlet end. During rotation, sequential lobes of the male rotor serve as pistons driving refrigerant downstream and compressing it within the space (compression pocket) between an adjacent pair of female rotor lobes and the housing. Likewise sequential lobes of the female rotor produce compression of refrigerant within a male rotor compression pocket between an adjacent pair of male rotor lobes and the housing. In one implementation, the male rotor is coaxial with an electric driving motor and is supported by bearings on inlet and outlet sides of its lobed working portion. There may be multiple female rotors engaged to a given male rotor or vice versa. With such a compressor, male and female compression pockets may also have multiple inlet and outlet ports.

When a compression pocket is exposed to an inlet port, the refrigerant enters the pocket essentially at suction pressure. As the pocket continues to rotate, at some point during its rotation, the pocket is no longer in communication with the inlet port and the flow of refrigerant to the pocket is cut off. Typically the inlet port geometry is arranged in such a way that the flow of refrigerant is cut off at the time in the cycle when the pocket volume reaches its maximum value. Typically the inlet port geometry is such that both male and female compression pockets are cut off at the same time. The inlet port is typically a combination of an axial port and a radial port. After the inlet port is closed, the refrigerant is compressed as the pockets continue to rotate and their volume is reduced. At some point during the rotation, each compression pocket intersects the associated outlet port and the closed compression process terminates. Typically outlet port geometry is such that both male and female pockets are exposed to the outlet port at the same time. As with the inlet port, the outlet port is normally a combination of an axial port and a radial port. By combining axial and radial ports into one design configuration, the overall combined port area is increased, minimizing throttling losses associated with pressure drop through a finite port opening area.

BRIEF SUMMARY OF THE INVENTION

Accordingly, one aspect of the invention involves a compressor having a housing containing male and female rotors with intermeshed screw-type bodies and held for rotation about respective axes. The housing has first and second portions respectively cooperating with the male and female rotors to respectively define inlet ports to respective male and female compression pockets. The housing has third and fourth portions respectively cooperating with the male and female rotors to respectively define outlet ports from the respective male and female compression pockets. The housing portions are positioned so that, with the male rotor revolving at a given speed, the male and female compression pockets are closed for unequal male and female durations.

In various implementations, the male duration may be less than the female duration. This may be by an exemplary time of between 0.5% and 20% of a cycle time at the speed. If the respective inlet ports are closed simultaneously, the male outlet port may be opened before the female outlet port. If the respective outlet ports are opened simultaneously, the female inlet port may be closed before the male inlet port. The male inlet port may close after the female inlet port while the male outlet port may open before the female outlet port. Volume indices of the male and female compression pockets may be within 5% of each other.

Another aspect of the invention is a method for engineering or reengineering a design of a compressor having intermeshed male and female lobed rotors. An initial design has initial male and female compression pocket volume indices and peak pressures under given operating conditions. The relative opening or closing time of male and female compression pockets in an embodiment of the design is varied. Volume indices or peak pressures reflecting the varying are observed. The varying and observations are repeated until the volume indices and/or peak pressures associated with the particular revised design are within a desired proximity, less than a difference between the initial male and female compression pocket volume indices and/or peak pressures. The embodiment may be a computer simulation. The volume indices may initially be mismatched by a factor of greater than 10% and may be corrected to within 5%.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

In the past it was believed that there is a sufficient communication between male and female compression pockets through a gap in the intermeshing region of the male and female rotors that would allow for pressure to balance between each of these pockets. Experiments show that this gap may not be sufficiently large to equalize the pressure between the pockets. This imbalance is especially pronounced with high speed screw compressors. Pressure imbalance between male and female compression pockets can contribute to compressor inefficiency.

Figure 1:
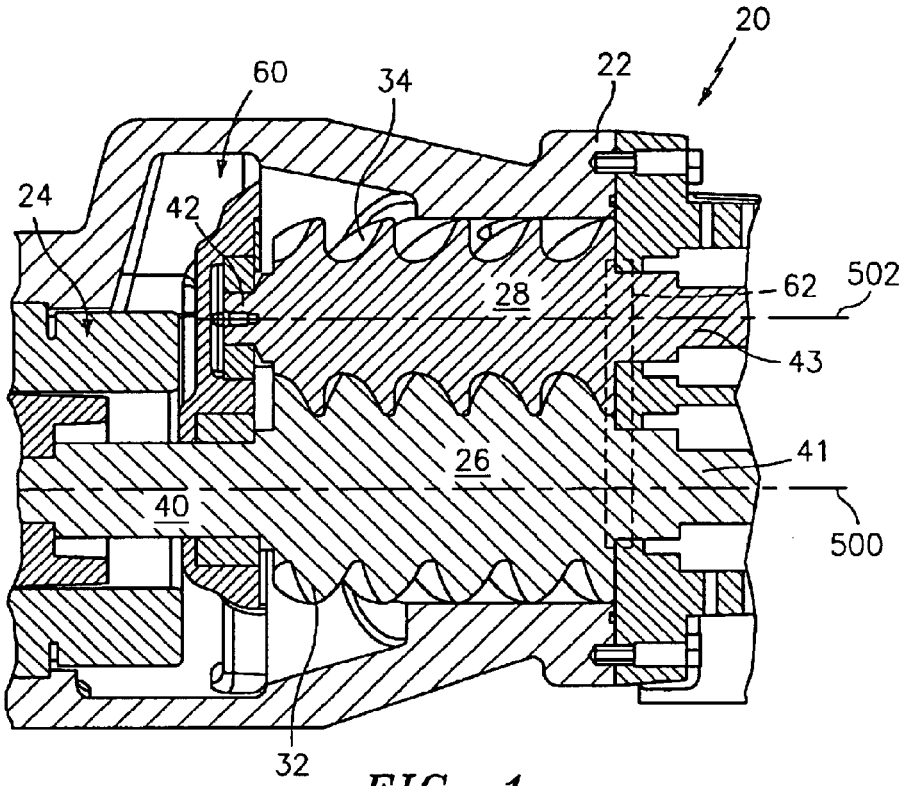
FIG. 1 is a partial semi-schematic longitudinal cutaway sectional view of a compressor.

Modifications are described to reduce this pressure imbalance between the compression pockets. FIG. 1 shows a compressor 20 having a housing assembly 22 containing a motor 24 driving rotors 26 and 28 having respective central longitudinal axes 500 and 502. In the exemplary embodiment, the male rotor 26 is centrally positioned within the compressor and has a male lobed body or working portion 32 enmeshed with female lobed body or working portion 34 of the female rotor 28. Each rotor includes shaft portions (e.g., stubs 40, 41, and 42, 43 unitarily formed with the associated working portion 32 and 34) extending from first and second ends of the working portion. Each of these shaft stubs is mounted to the housing by one or more bearing assemblies for rotation about the associated rotor axis.

In the exemplary embodiment, the motor 24 is an electric motor having a rotor and a stator. A portion of the first shaft stub 40 of the male rotor 26 extends within the stator and is secured thereto so as to permit the motor 24 to drive the male rotor 26 about the axis 500. When so driven in an operative first direction about the axis 500, the male rotor drives the female rotors in opposite directions about their axes 502 and 504. The resulting enmeshed rotation of the rotor working portions tends to drive fluid from a first (inlet) end plenum 60 to a second (outlet) end plenum 62 (shown schematically) while compressing such fluid. This flow defines downstream and upstream directions.

Surfaces of the housing combine with the rotors to define respective inlet and outlet ports to a pair of compression pockets. In each pair (e.g., two pairs if a second female rotor were provided in a three-rotor design), one such pocket is located between a pair of adjacent lobes of each rotor. Depending on the implementation, the ports may be radial, axial, or a hybrid of the two.

Figure 2:
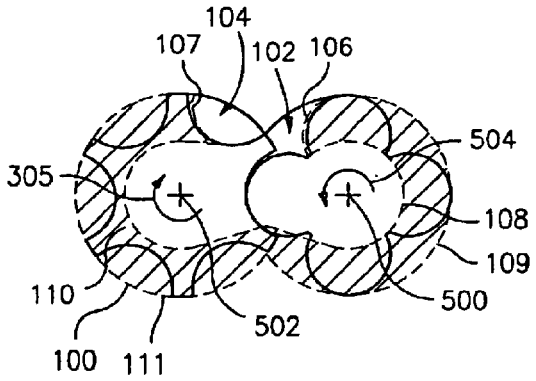
FIG. 2 (PRIOR ART)
FIG. 2 is a partially schematic outline view of a prior art compressor axial inlet port.

FIG. 2 shows an outline 100 of an exemplary prior art axial inlet port for male and female rotors in intermeshed rotation in directions 504 and 505. The axial inlet port extends generally along annular areas of a radial span between radii of lobe roots and lobe tips. Within these annular spans, the axial inlet port does not include areas 102 and 104 for the male and female rotors respectively. At these blocked (by the housing) areas or portions the port has respective ends 106, 107 extending between respective pairs of root and tip radii circular portions 108, 109, and 110, 111. The ends 106 and 107 have shape complementary to leading profiles of the respective rotor lobes. FIG. 2 specifically shows the rotors in a position wherein lobes at the 12:00 position are about to reach the ends 106 and 107 to seal the compression pockets thereahead.

Figure 3:
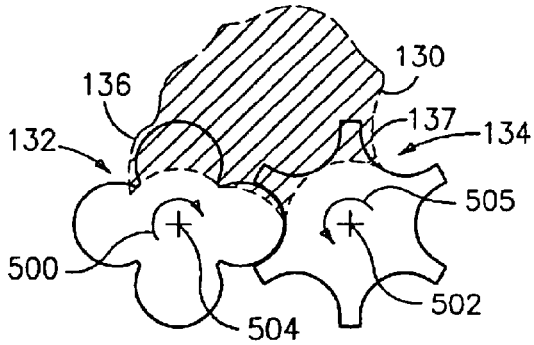
FIG. 3 (PRIOR ART)
FIG. 3 is a partially schematic outline view of a prior art compressor axial outlet port.

FIG. 3 shows an outline 130 of an exemplary prior art axial outlet port. The port only covers relatively small angular spans of the working portions, leaving relatively large blocked areas 132 and 134. The port has respective ends 136 and 137 extending across the lobe root to tip annuli. These ends have profiles complementary to trailing profiles of the lobes. FIG. 3 specifically shows rotor lobes in the 12:00 position having just cleared the respective ends 136 and 137 to expose the compression pockets therebehind to the outlet plenum.

Figure 4:
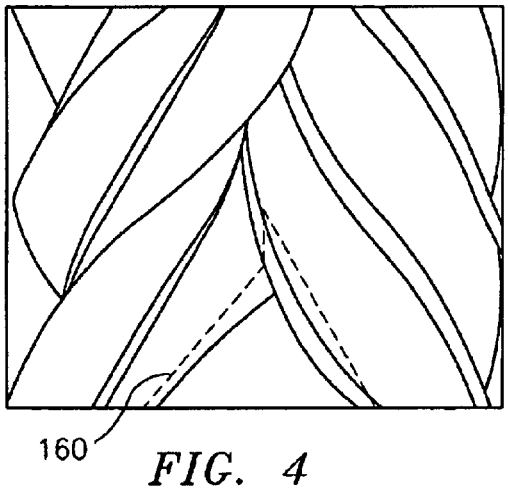
FIG. 4 (PRIOR ART)
FIG. 4 is a partially schematic outline view of a prior art compressor radial outlet port.
Figure 5:
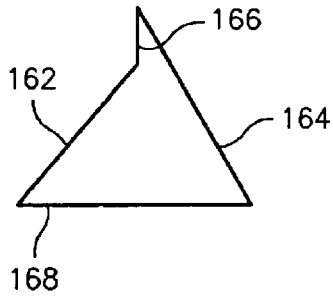
FIG. 5 (PRIOR ART)
FIG. 5 is a flattened view of the outline of FIG. 4.

FIG. 4 shows an outline 160 of an exemplary prior art radial outlet port. Because the port includes portions along outer diameters (OD's) of the rotor working portions, FIG. 5 shows a flattened depiction of the port outline 160. The port has a first portion 162 lying helically along the OD of the male rotor lobe portion and a second portion 164 lying helically along the OD of the female rotor lobed working portion. These two portions are positioned to align and effectively seal with the apexes of an adjacent intermeshed male and female lobe at particular points in the compressor cycle. They are joined by a transition 166 adjacent the line of intermeshing and by a portion 168 adjacent the end faces of the working portions. This positioning provides that when the rotors rotate further beyond the orientation of FIG. 4, a male and female lobe at sides of respective male and female compression pockets will simultaneously pass out of a sealing relation with the housing at the port and, thereby, vent such compression pockets simultaneously to the outlet plenum.

If an inlet radial port is employed, this port may be similarly formed to simultaneously initiate compression in both pockets.

Figure 6:
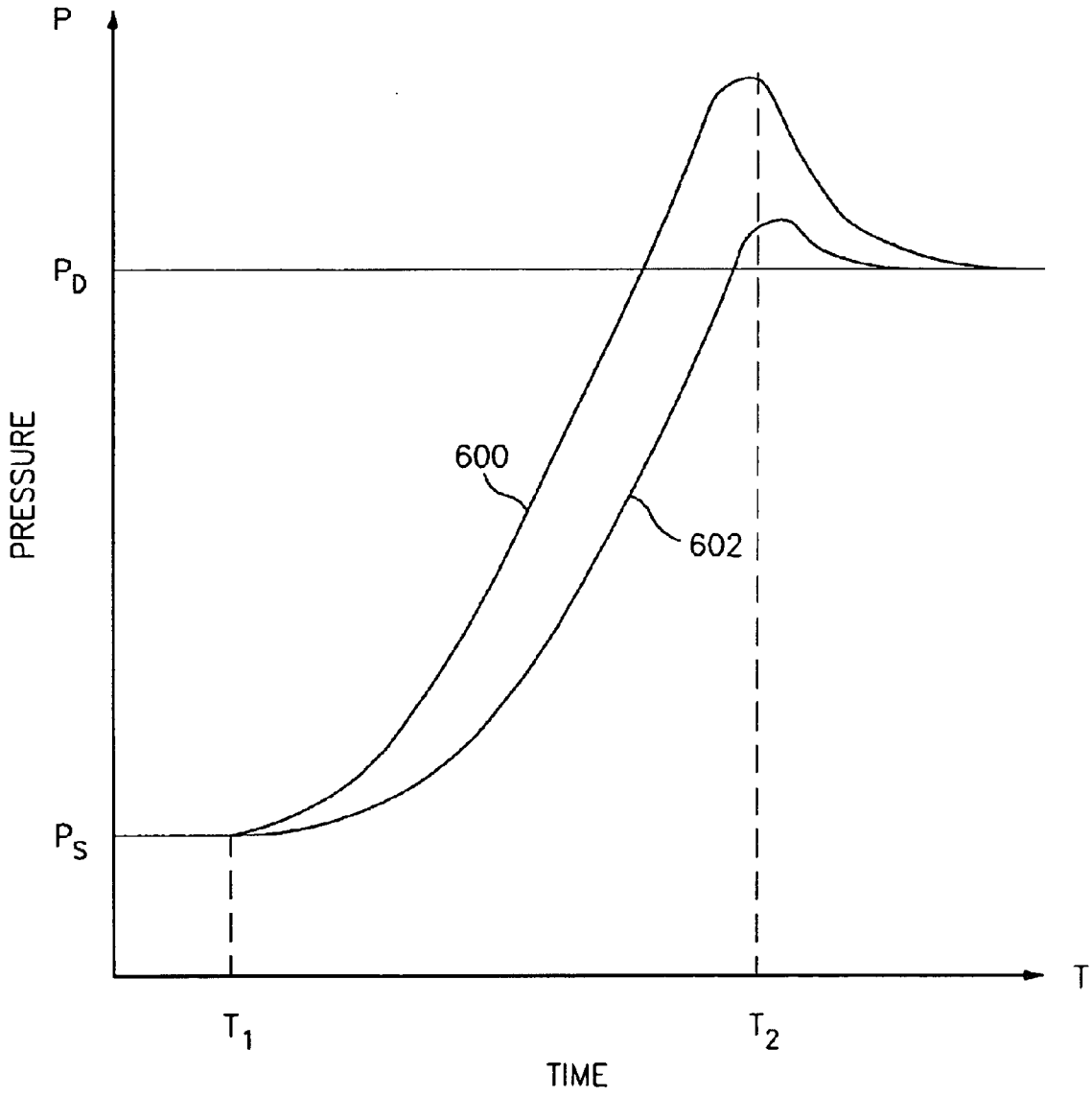
FIG. 6 (PRIOR ART)
FIG. 6 is a graph of pressure against time for a prior art compressor.

FIG. 6 shows the pressures in the exemplary prior art compression pockets as a function of time. The differing geometry between the male and female compression pockets may contribute to imbalanced pressure between the two pockets. In the example of FIG. 6, the pressure rises faster in the male compression pocket than in the female compression pocket. For example, if the ports are positioned for simultaneous inlet closing ($T_1$) of the male and female compression pockets and simultaneous outlet opening ($T_2$) of those pockets to outlet ports, the volume indices and thus discharge pressures for the male and female compression pockets may differ. In such a system, one or both indices will differ from the desired system volume index. In the exemplary prior art system the male volume index is higher than the female volume index. Thus, starting from a desired inlet (suction) pressure $P_S$, the pressure 600 in the male compression pocket will peak at a value substantially higher than the pressure 602 in the female compression pocket and a desired outlet (discharge) pressure $P_D$.

Figure 7:
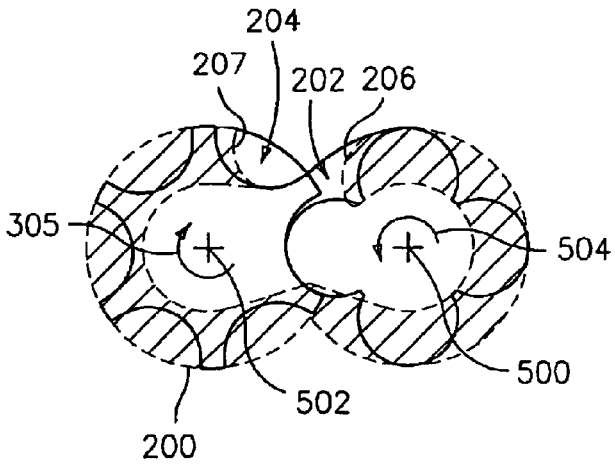
FIG. 7 is a partially schematic outline view of a modified compressor axial inlet port.

By repositioning one or both of the male compression pocket inlet and outlet ports, the volume index of the male compression pocket may be brought closer to that of the female compression pocket to bring both their discharge pressures closer to the desired $P_D$. FIG. 7 shows an outline 200 of a modified axial inlet port that delays the inlet closing of the male compression pocket. This modification may include removing material from the housing at the male compression pocket end of the axial inlet port. In the illustrated embodiment, the end 206 is shifted slightly in the direction of rotation 504 (counterclockwise in the illustrated embodiment) relative to the end 106 of the prior art port. This reduces the size of the blocked area 202. In the illustrated embodiment, the port end 207 for the female compression pocket and the blocked area 204 are coincident with the end 107 and blocked area 104 of FIG. 2 as are other port features. As its inlet closing is delayed by the modification, the male compression pocket remains open to suction pressure for a longer period of time. As a result, the start of compression in this pocket is delayed. This delay lowers pressure in this pocket during compression, bringing it closer to pressure in female pocket. This reduces peak pressure upon discharge, thus effectively reducing the work of compression.

Figure 8:
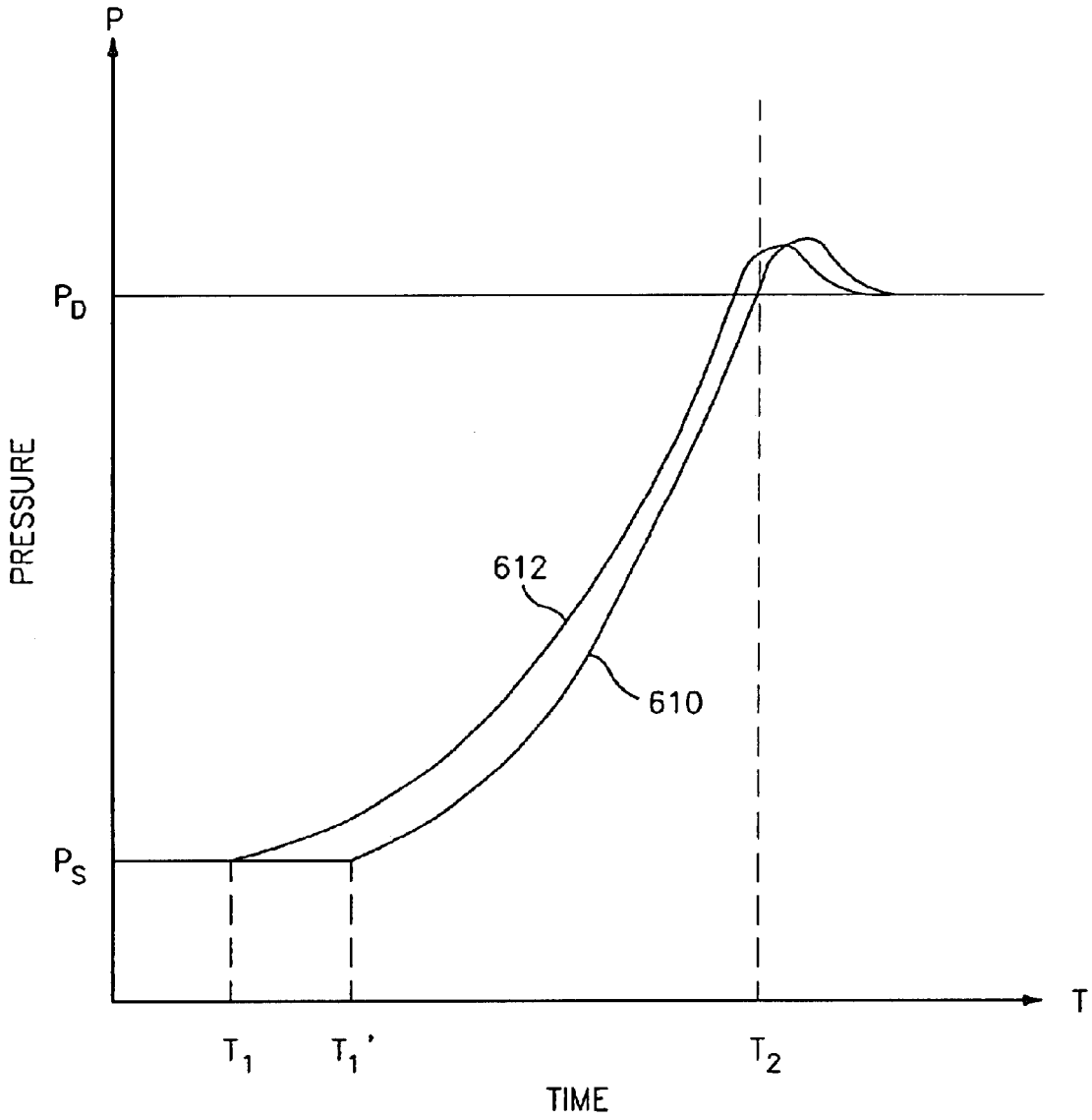
FIG. 8 is a graph of pressure against time for a compressor of FIG. 7.

FIG. 8 shows the pressures 610 and 612 in the male and female compression pockets of this modified compressor as a function of time. With other factors held constant, the pressure 612 may be similar to the pressure 602. The modification delays the inlet closing of the male compression pocket to a time $T_1'$. The delay effectively reduces the volume index of the male compression pocket and, thereby, its peak pressure. The delay ($T_1$–$T_1'$) would normally be from 1% to 20% of a cycle time, more narrowly 3% to 6%. An alternative or supplement to the removal of material from the male inlet port end is the addition of material to the female inlet port end.

Figure 9:
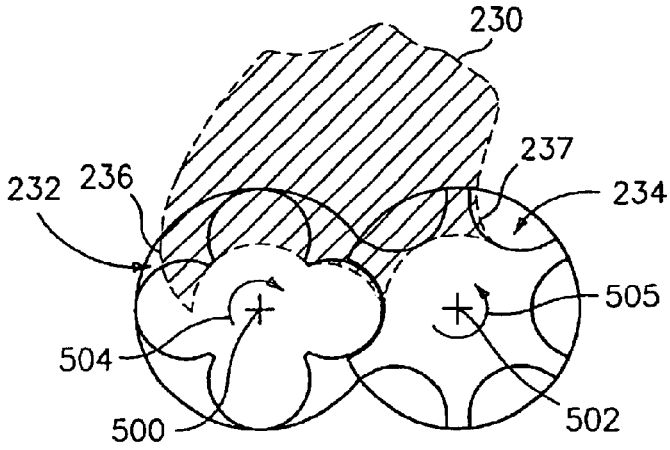
FIG. 9 is a partially schematic outline view of a modified compressor axial outlet port.

FIG. 9 shows an outline 230 of a modified axial outlet port that expedites the outlet opening of the male compression pocket. This modification may include removal of material from the housing at the male compression pocket end of the axial outlet port. In the illustrated embodiment, the end 236 is shifted in the opposite of the direction 504 relative to the end 136 of FIG. 3. This reduces the blocked area 232 relative to the area 132. The female end 237 and blocked area 234 may be coincident with the end 137 and area 134 of FIG. 3 as may other port features.

Figure 10:
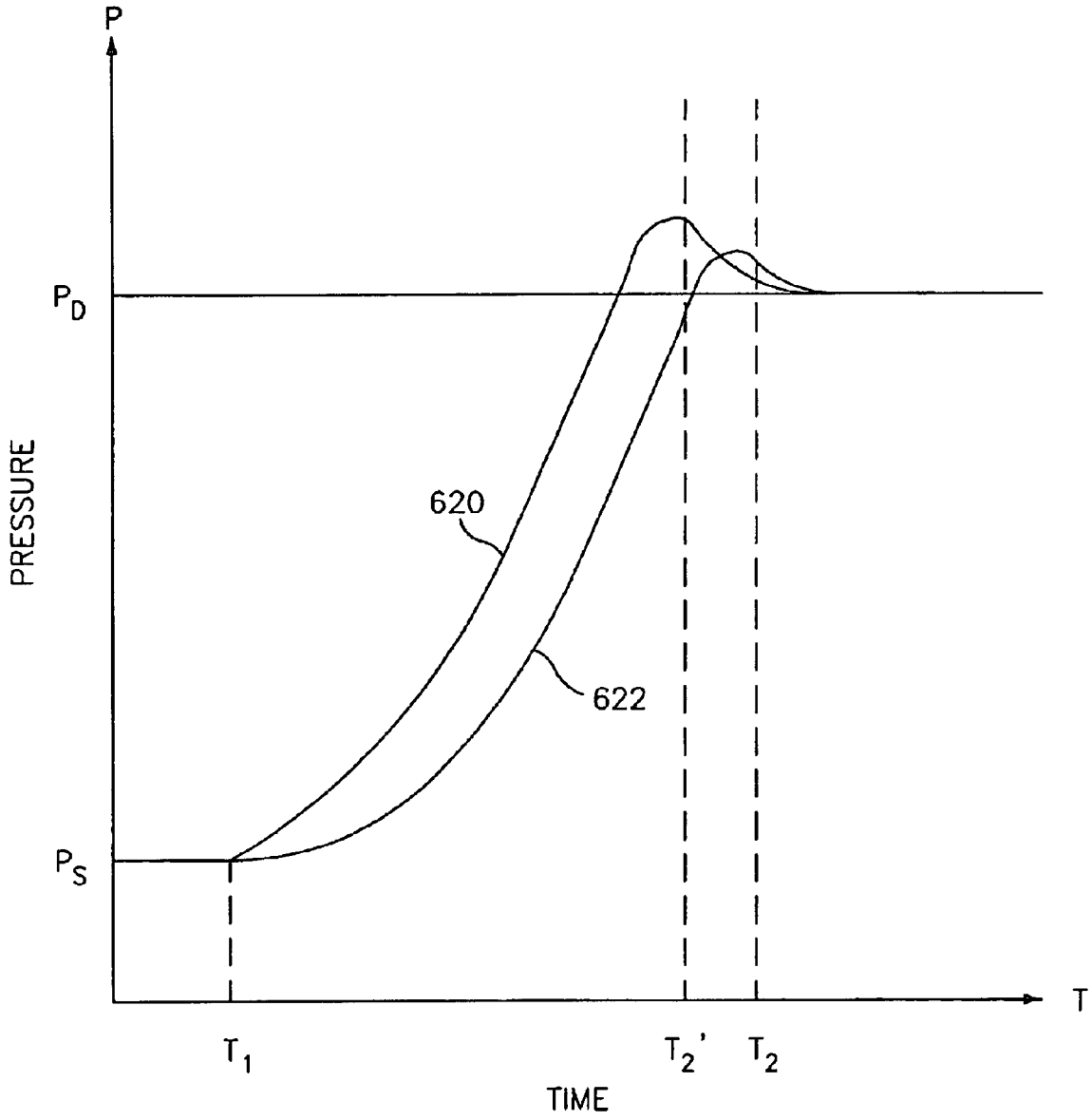
FIG. 10 is a graph of pressure against time for a compressor of FIG. 9.

FIG. 10 shows the pressures 620 and 622 in the male and female compression pockets of this modified compressor as a function of time. With other factors held constant, the pressure 622 may be similar to the pressure 602. The modification hastens the outlet opening of the male compression pocket to a time $T_2'$ which is a fraction of a cycle earlier than $T_2$. As with the FIG. 7 embodiment, the duration for which a male compression pocket is closed is shorter than that of the female. The earlier opening of the port on the male side effectively reduces the volume index of the male compression pocket and, thereby, its peak pressure, bringing it closer to pressure in the female pocket. As with the inlet port, a possible alternative or supplement to removal of material from the end of the male outlet port is addition of material to the end of the female outlet port.

Figure 11:
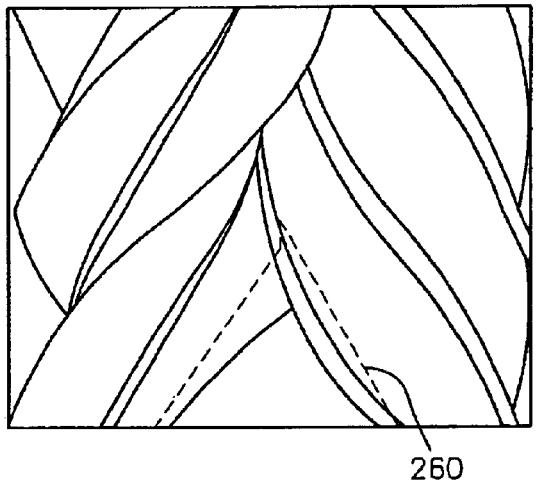
FIG. 11 is a partially schematic outline view of a modified compressor radial outlet port.
Figure 12:
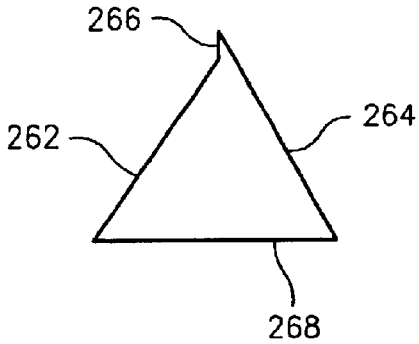
FIG. 12 is a flattened view of the outline of FIG. 11.

FIG. 11 shows an outline 260 of a modification of a radial outlet port that may advantageously be done in conjunction with above-described modification of the axial outlet port. This modification also hastens the outlet opening of the male compression pocket and produces results similar to those shown in FIG. 10. FIG. 12 shows a flattened depiction of the port outline 260. In a simple modification of the outline 160 of FIGS. 4 and 5, the outline 260 has portions 262, 264, 266 and 268 corresponding to the portions 162, 164, 166 and 168. The portion 262 along the helix of the male rotor is shifted axially toward the inlet relative to that of FIG. 4. The portion 266 along the mesh line is accordingly, shortened relative to the portion 166. The shift is by a fraction of the axial pitch of the lobes. The shift may involve an exemplary time shift of between 0.5% and 10% of a cycle time. Similar changes may be made to a radial inlet port (not shown). Depending upon design considerations, an equivalent shift at the inlet port may involve a greater fraction of cycle time than at the outlet port (e.g., if pressures are rising faster near discharge time than near the beginning of the compression cycle).

Figure 14:
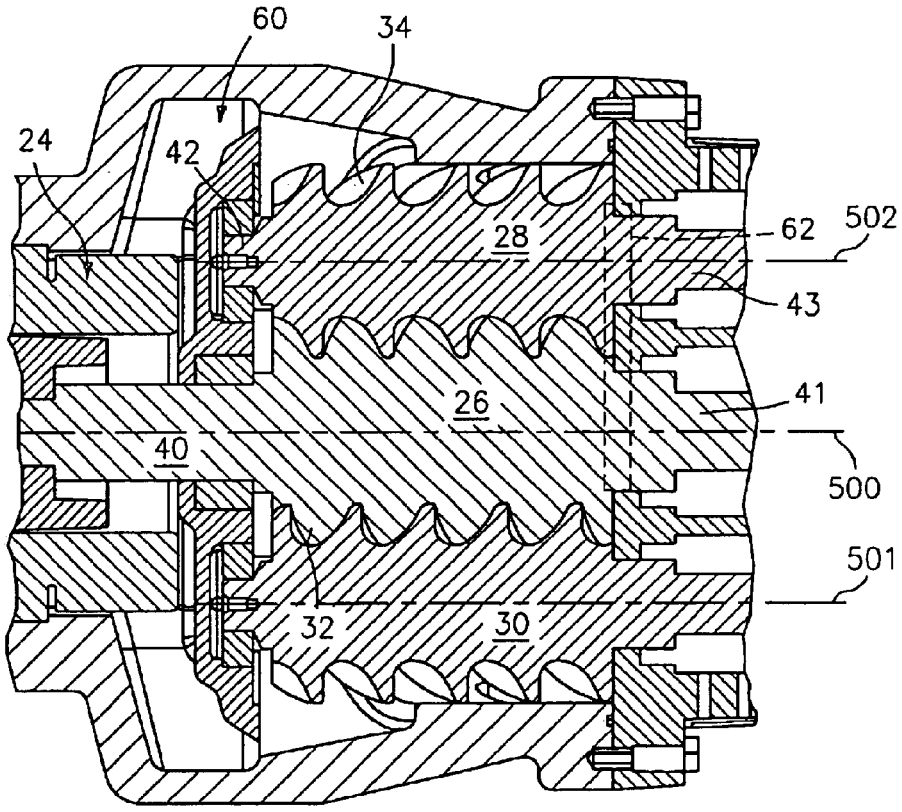
FIG. 14 is a view of a three-rotor compressor.
Figure 13:
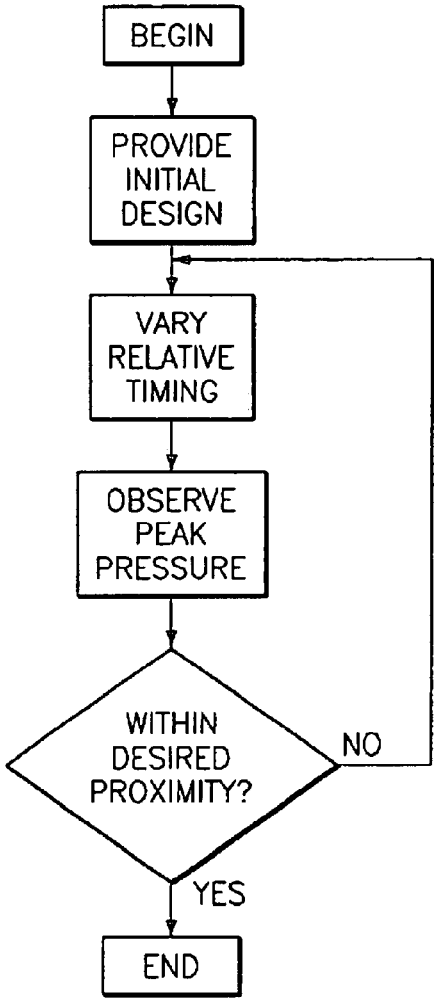
FIG. 13 is a flowchart of a timing optimization method according to principles of the invention.
Figure 15:
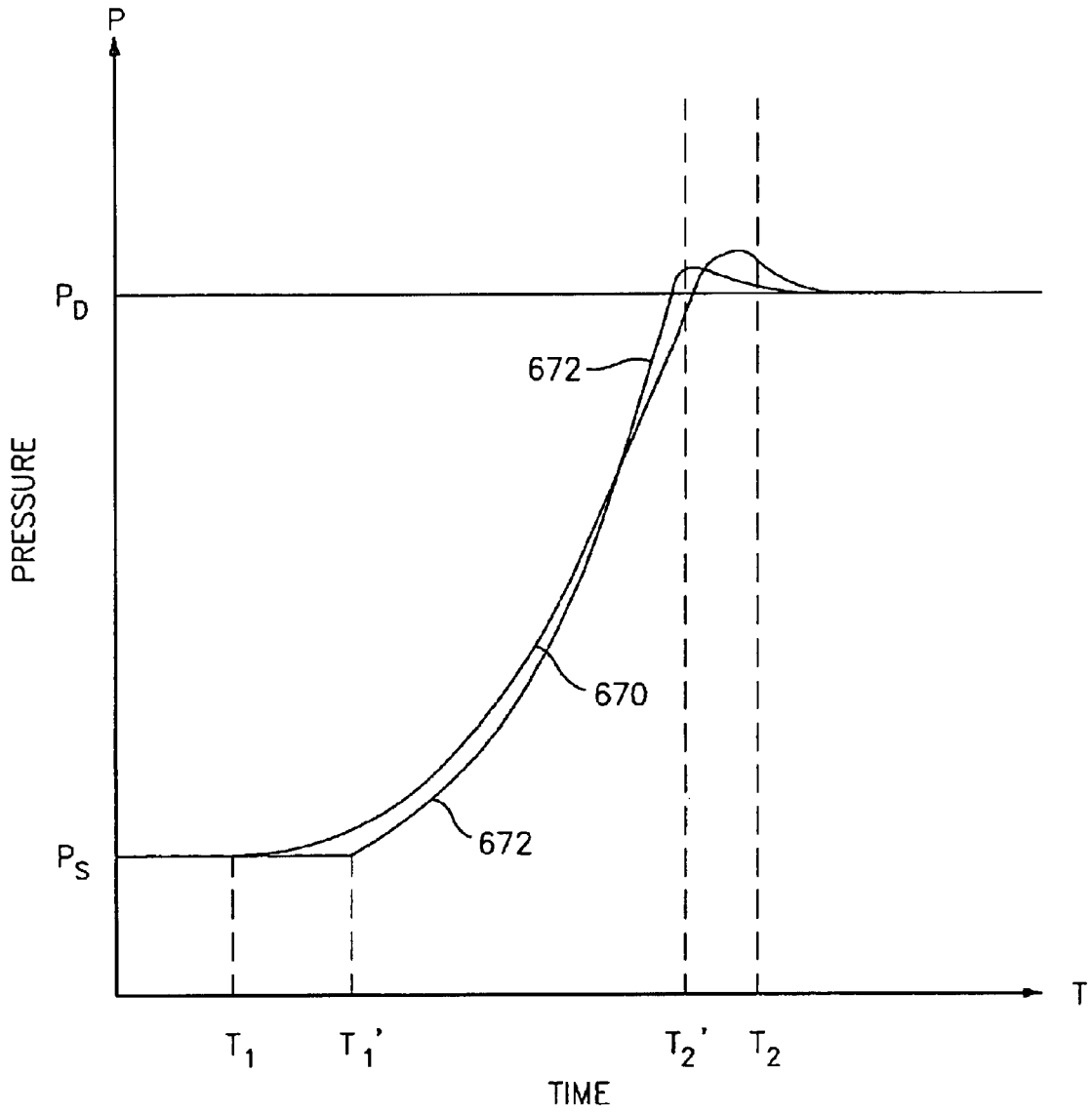
FIG. 15 is a graph of pressure against time for a compressor having the inlet port configuration of FIG. 7 and the outlet port configuration of FIG. 9.

FIG. 13 shows an optimization method as discussed above and in further detail below. FIG. 14 shows a three-rotor compressor with a second female rotor 30 having an axis 501 and cooperating with the male rotor 26 in a similar fashion to the female rotor 28. FIG. 15 shows plots 670 and 672 of female and male compression pocket pressures. The female compression pocket inlet port closes at time $T_1$ before the male compression pocket inlet port closes at time $T_1'$. The male compression pocket outlet port opens at time $T_2'$ before the female compression pocket outlet port opens at time $T_2$.

The foregoing teachings may be applied to other hybrid ports (not shown) where changes to radial and axial port are made simultaneously. Furthermore, the modifications to inlet and outlet ports may be simultaneous. For example, the housing surfaces forming the inlet and outlet radial ports for the male compression pocket may both be shifted slightly longitudinally inward to reduce the volume index of the male compression pocket to closely approximate that of the female. In such a simultaneous modification, the combined longitudinal shift would be expected to correspond to the otherwise larger longitudinal shift of a single modified port. A particular modification may be chosen not merely to balance pressures but also to properly phase inlet or discharge timing (e.g., to achieve a smooth operation). The modification to the outlet port may not appreciably affect machine capacity. The modification to the inlet port may slightly reduce machine capacity due to the delay in initiation of compression. Thus, for example, if it is desired to maintain similar capacity in a redesigned compressor the modification may preferably be made to the outlet port. However, if it is also desired to slightly reduce the capacity then the modification may preferably be made to the inlet port.

The optimization of the parameters to achieve a desired operation may be iteratively resolved on an embodiment of the compressor's design. Such embodiment may be a physical embodiment such as an actual compressor or rotor pair, a partial compressor, or a model appropriately scaled for simulation purposes, or may be in the form of a computer simulation. In such an iterative design process, the port modifications may be induced under the anticipated operating conditions and the resulting effect on various pressures observed. The parameters may be varied and the simulation repeated until a desired performance is achieved.

One or more embodiments of the present invention have been described. Nevertheless, it will be understood that various modifications may be made without departing from the spirit and scope of the invention. For example, the principles may be applied to various compressor constructions, rotor geometries, etc. Such compressors may have additional features or options that may influence the particular implementation. If the principles are implemented in a retrofit of an existing compressor, features of the existing compressor will have a substantial influence on the implementation as they would if the principles were applied to a more comprehensive redesign of the existing compressor. For example, it can be used in a tri-rotor configuration where similar modifications can be made to a second pair of inlet and outlet ports. Also, although examples involve correcting for faster compression in the male compression pocket, other potential compressor configurations may require compensation for faster compression in the female compression pocket. In such a situation the identified modifications could be reversed (e.g. by removing material from the female portion of the radial and/or axial inlet and/or outlet ports or adding material to the male portion of the radial and/or axial inlet and/or outlet ports). Accordingly, other embodiments are within the scope of the following claims.

What is claimed is:

1. A compressor comprising:

a housing assembly;

a male rotor having a screw-type male body portion, the male rotor extending from a first end to a second end and held within the housing assembly for rotation about a first rotor axis; and a female rotor having a screw-type female body portion enmeshed with the male body portion, the female rotor extending from a first end to a second end and held within the housing assembly for rotation about a second rotor axis, wherein:

the housing has first and second portions respectively cooperating with the male and female rotors to respectively define inlet ports to respective male and female compression pockets;

the housing has third and fourth portions respectively cooperating with the male and female rotors to respectively define outlet ports from said respective male and female compression pockets;

the first, second, third, and fourth housing portions are positioned so that with the male rotor revolving at a given speed, the male and female compression pockets are closed for unequal male and female durations;

the male compression pocket outlet port is open before the female compression pocket outlet port; and the female compression pocket inlet port is closed before the male compression pocket inlet port.

2. The compressor of claim 1 wherein:

the male duration is less than the female duration by a time between 0.5% and 20% of a cycle time at the speed.

3. The compressor of claim 1 wherein:

a volume index of the male compression pocket is within 5% of a volume index of the female compression pocket.

4. A method for engineering or reengineering a design of a compressor having intermeshed male and female lobed rotors, the method comprising:

providing said design having initial male and female compression pocket peak pressure under given operating conditions;

varying a relative opening or dosing time of male and female compression pockets in an embodiment of the design;

observing male and female compression pocket peak pressures reflecting the varying; and repeating the varying and observing until the male and female peak pressures associated with a particular revised design are within a desired proximity, less than a difference between the initial male and female compression pocket peak pressures.

5. The method of claim 4 wherein the embodiment is a computer simulation.

6. The method of claim 4 being a reengineering from an initial design to a reengineered design and wherein:

in the initial design the male and female compression pockets each have an inlet port and an outlet port; and the varying comprises varying a physical stagger of the mule and female compression pocket inlet ports or the male and female compression pocket outlet ports from an initial non-zero stagger to a different non-zero stagger.

7. The method of claim 4 being a reengineering from an initial design to a reengineered design and wherein:

in the initial design the male and female compression pockets have inlet closing and outlet opening characteristics;

in the reengineered design the male and female compression pockets each have inlet closing and outlet opening characteristics; and the reengineering essentially time shifts at least one of said characteristics of the reengineered design relative to the corresponding characteristic of the initial design.

8. The method of claim 7 wherein the reengineering maintains both inlet closing and outlet opening characteristics of one of the compression pockets between the initial design and the reengineered design.

* * * * *

UNITED STATES PATENT AND TRADEMARK OFFICE

CERTIFICATE OF CORRECTION

PATENT NO. : 6,821,098 B2
DATED : November 23, 2004
INVENTOR(S) : Alexander Lifson It is certified that error appears in the above-identified patent and that said Letters Patent is hereby corrected as shown below:

Column 7,
Line 36, “dosing” should read -- closing --.

Column 8,
Line 16, “mule” should read -- male --.

Signed and Sealed this

Twenty-second Day of February, 2005

JON W. DUDAS
*Director of the United States Patent and Trademark Office*